US008517765B2

(12) United States Patent
Schroll et al.

(10) Patent No.: US 8,517,765 B2
(45) Date of Patent: Aug. 27, 2013

(54) CABLE HEADER CONNECTOR

(75) Inventors: Neil Franklin Schroll, Mount Joy, PA (US); Timothy Robert Minnick, Enola, PA (US); Samuel J. Magaro, Jr., Enola, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/314,380

(22) Filed: Dec. 8, 2011

(65) Prior Publication Data

US 2013/0149890 A1 Jun. 13, 2013

(51) Int. Cl.
*H01R 13/648* (2006.01)

(52) U.S. Cl.
USPC ..... 439/607.27; 439/108

(58) Field of Classification Search
USPC ..... 439/98, 101, 108, 353–358, 607.1, 439/607.27, 607.35–607.37, 607.45
See application file for complete search history.

(56) References Cited

U.S. PATENT DOCUMENTS

| | | | | |
|---|---|---|---|---|
| 5,417,590 | A * | 5/1995 | Dechelette et al. | 439/607.48 |
| 5,518,421 | A * | 5/1996 | Davis | 439/607.5 |
| 6,273,762 | B1 * | 8/2001 | Regnier | 439/701 |
| 6,471,549 | B1 | 10/2002 | Lappohn | |
| 6,592,390 | B1 * | 7/2003 | Davis et al. | 439/352 |
| 7,267,515 | B2 | 9/2007 | Lappohn | |
| 7,410,393 | B1 | 8/2008 | Rothermel et al. | |
| 7,566,247 | B2 | 7/2009 | Rothermel et al. | |
| 7,604,496 | B2 * | 10/2009 | Takeuchi et al. | 439/358 |
| 7,628,638 | B2 * | 12/2009 | Wu | 439/358 |
| 7,637,767 | B2 | 12/2009 | Davis et al. | |
| 7,744,414 | B2 * | 6/2010 | Scherer et al. | 439/607.05 |
| 8,100,709 | B2 * | 1/2012 | Zhang | 439/353 |
| 8,142,224 | B2 * | 3/2012 | Wu | 439/607.27 |
| 2011/0281464 | A1 | 11/2011 | Hou | |

FOREIGN PATENT DOCUMENTS

| | | | |
|---|---|---|---|
| EP | 2194612 | A1 | 6/2010 |
| NL | 1017518 | C2 | 9/2002 |
| WO | 2011094656 | A2 | 8/2011 |

OTHER PUBLICATIONS

International Search Report, International Application No. PCT/US2012/066509, International Filing Date Nov. 26, 2012.

* cited by examiner

*Primary Examiner* — Thanh Tam Le

(57) ABSTRACT

A cable header connector includes a cable assembly having a contact sub-assembly and a ground shield coupled to and providing electrical shielding for the contact sub-assembly. The contact sub-assembly has a mounting block with contact channels therein. The contact sub-assembly has signal contacts received in the contact channels and extending between mating and terminating ends. The signal contacts are terminated to corresponding signal wires. The ground shield has walls extending along the signal contacts and has mating and terminating ends. The mating end is positioned either at or beyond the mating ends of the signal contacts. The terminating end is positioned either at or beyond the terminating ends of the signal contacts such that the ground shield provides shielding along the entire length of the signal contacts.

20 Claims, 5 Drawing Sheets

CABLE HEADER CONNECTOR

CROSS REFERENCE TO RELATED APPLICATIONS

This application relates to U.S. patent application Ser. No. titled CABLE HEADER CONNECTOR having application Ser. No. 13/314,336 filed concurrently herewith, to U.S. patent application Ser. No. titled CABLE HEADER CONNECTOR having application Ser. No. 13/314,415 filed concurrently herewith, and to U.S. patent application Ser. No. titled CABLE HEADER CONNECTOR having application Ser. No. 13/314,458 filed concurrently herewith, the subject matter of each of which is herein incorporated by reference in its entirety.

BACKGROUND OF THE INVENTION

The subject matter herein relates generally to cable header connectors.

High speed differential connectors are known and used in electrical systems, such as communication systems to transmit signals within a network. Some electrical systems utilize cable mounted electrical connectors to interconnect the various components of the system.

Signal loss and/or signal degradation is a problem in known electrical systems. For example, cross talk results from an electromagnetic coupling of the fields surrounding an active conductor or differential pair of conductors and an adjacent conductor or differential pair of conductors. The strength of the coupling generally depends on the separation between the conductors, thus, cross talk may be significant when the electrical connectors are placed in close proximity to each other.

Moreover, as speed and performance demands increase, known electrical connectors are proving to be insufficient. Additionally, there is a desire to increase the density of electrical connectors to increase throughput of the electrical system, without an appreciable increase in size of the electrical connectors, and in some cases, a decrease in size of the electrical connectors. Such increase in density and/or reduction in size causes further strains on performance.

In order to address performance, some known systems utilize shielding to reduce interference between the contacts of the electrical connectors. However, the shielding utilized in known systems is not without disadvantages. For instance, at the interface between the signal conductors and the cables signal degradation is problematic due to improper shielding at such interface. The termination of the cable to the signal conductors is a time consuming and complicated process. In some systems, the cables include drain wires, which are difficult and time consuming to terminate within the connector due to their relatively small size and location in the cable. For example, the drain wires are soldered to a grounded component of the electrical connector, which is time consuming. Furthermore, general wiring practices require that the drain either be placed facing upward or placed facing downward at the termination, which adds complexity to the design of the grounded component of the electrical connector and difficulty when soldering the drain wire at assembly. Motion of the cable during handling can add unwanted stresses and strains to the cable terminations resulting in discontinuity or degraded electrical performance. Additionally, consistent positioning of the wires of the cables before termination is difficult with known electrical connectors and improper positioning may lead to degraded electrical performance at the termination zone. When many cable assemblies are utilized in a single electrical connector, the grounded components of the cable assemblies are not electrically connected together, which leads to degraded electrical performance of the cable assemblies.

A need remains for an electrical system having improved shielding to meet particular performance demands.

BRIEF DESCRIPTION OF THE INVENTION

In one embodiment, a cable header connector is provided having a cable assembly including a contact sub-assembly configured to be terminated to a cable and a ground shield coupled to and providing electrical shielding for the contact sub-assembly. The contact sub-assembly has a mounting block that has a contact channels therein. The contact sub-assembly has a pair of signal contacts each received in corresponding contact channels. The signal contacts extend between mating ends and terminating ends. The signal contacts are terminated to corresponding signal wires of the cable at the terminating ends. The ground shield has walls that extend along the signal contacts. The ground shield has a mating end and a terminating end. The mating end of the ground shield is positioned either at or beyond the mating ends of the signal contacts. The terminating end of the ground shield is positioned either at or beyond the terminating ends of the signal contacts such that the ground shield provides shielding along the entire length of the signal contacts.

In another embodiment, a cable header connector is provided having a contact module that has a support body and a plurality of cable assemblies held by the support body. Each cable assembly includes a contact sub-assembly configured to be terminated to a cable and a ground shield coupled to and providing electrical shielding for the contact sub-assembly. The support body engages and supports the ground shields of the cable assemblies. The contact sub-assembly has a mounting block that has contact channels therein. The contact sub-assembly has a pair of signal contacts each received in corresponding contact channels. The signal contacts extend between mating ends and terminating ends. The signal contacts are terminated to corresponding signal wires of the cable at the terminating ends. The ground shield has walls that extend along the signal contacts. The ground shield has a mating end and a terminating end. The mating end of the ground shield is positioned either at or beyond the mating ends of the signal contacts. The terminating end of the ground shield is positioned either at or beyond the terminating ends of the signal contacts such that the ground shield provides shielding along the entire length of the signal contacts.

In a further embodiment, a cable header connector is provided having a header housing including a base wall. Contact modules are coupled to the base wall. Each contact module has a support body and a plurality of cable assemblies held by the support body. Each cable assembly includes a contact sub-assembly configured to be terminated to a cable and a ground shield coupled to and providing electrical shielding for the contact sub-assembly. The support body engages and supports the ground shields of the cable assemblies. The contact sub-assembly has a mounting block that has contact channels therein. The contact sub-assembly has a pair of signal contacts each received in corresponding contact channels. The signal contacts extend between mating ends and terminating ends. The signal contacts are terminated to corresponding signal wires of the cable at the terminating ends. The ground shield has walls that extend along the signal contacts. The ground shield has a mating end and a terminating end. The mating end of the ground shield is positioned either at or beyond the mating ends of the signal contacts. The terminating end of the ground shield is positioned either at or beyond the terminating ends of the signal contacts such that the ground shield provides shielding along the entire length of the signal contacts.

DETAILED DESCRIPTION OF THE INVENTION

Figure 1:
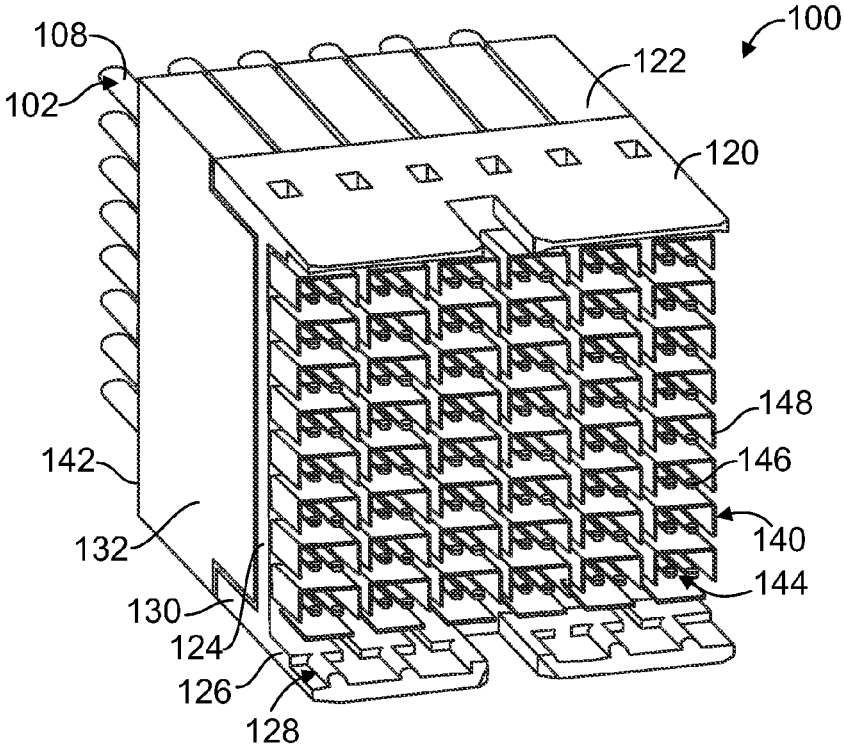
FIG. 1 is a front perspective view of a cable header connector formed in accordance with an exemplary embodiment.
Figure 2:
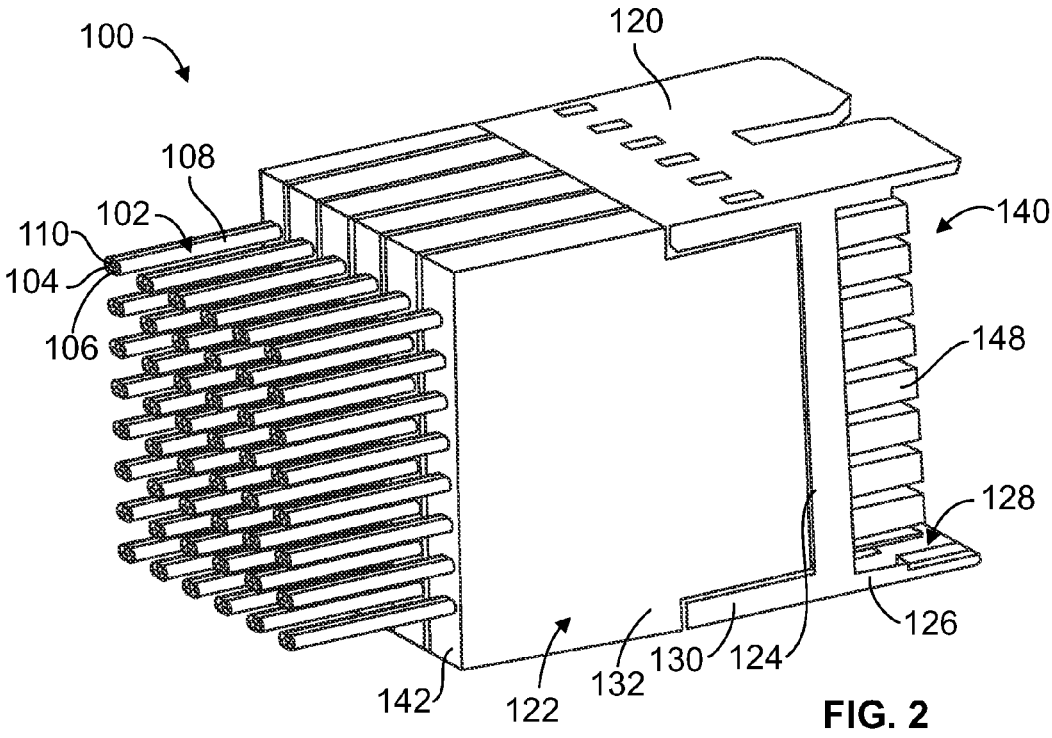
FIG. 2 is a rear perspective of the cable header connector shown in FIG. 1.

FIG. 1 is a front perspective view of a cable header connector 100 formed in accordance with an exemplary embodiment. FIG. 2 is a rear perspective of the cable header connector 100. The cable header connector 100 is configured to be mated with a receptacle connector (not shown). The receptacle connector may be board mounted to a printed circuit board or terminated to one or more cables, for example. The cable header connector 100 is a high speed differential pair cable connector that includes a plurality of differential pairs of conductors mated at a common mating interface. The differential conductors are shielded along the signal paths thereof to reduce noise, crosstalk and other interference along the signal paths of the differential pairs.

A plurality of cables 102 extend rearward of the cable header connector 100. In an exemplary embodiment, the cables 102 are twin axial cables having two signal wires 104, 106 within a common jacket 108 of the cable 102. In an exemplary embodiment, each of the signal wires 104, 106 are individually shielded, such as with a cable braid. The cable braids define grounded elements of the cable 102. A drain wire 110 is also provided within the jacket 108 of the cable 102. The drain wire 110 is electrically connected to the shielding of the signal wires 104, 106. The drain wire 110 defines a grounded element of the cable 102. Optionally, the cable 102 may include cable braids surrounding the signal wires 104, 106 that define grounded elements. The signal wires 104, 106 convey differential signals. The grounded elements of the cable 102 provide shielding for the signal wires 104, 106 into the cable header connector 100. Other types of cables 102 may be provided in alternative embodiments. For example, coaxial cables may extend from the cable header connector 100 carrying a single signal conductor therein.

The cable header connector 100 includes a header housing 120 holding a plurality of contact modules 122. The header housing 120 includes a base wall 124. The contact modules 122 are coupled to the base wall 124. In the illustrated embodiment, the header housing 120 includes shroud walls 126 extending forward from the base wall 124 to define a mating cavity 128 of the cable header connector 100. The shroud walls 126 guide mating of the cable header connector 100 with the receptacle connector during mating thereto. In the illustrated embodiment, the header housing 120 has support walls 130 extending rearward from the base wall 124. The contact modules 122 are coupled to the support walls 130. The support walls 130 may include features to guide the contact modules 122 into position with respect to the header housing 120 during mating of the contact modules 122 to the header housing 120. The support walls 130 define a module cavity 132 that receives at least portions of the contact modules 122 therein. The support walls 130 may include latching features that engage the contact modules 122 to secure the contact modules 122 to the header housing 120.

Each of the contact modules 122 include a plurality of cable assemblies 140 held by a support body 142. Each cable assembly 140 includes a contact sub-assembly 144 configured to be terminated to a corresponding cable 102. The contact sub-assembly 144 includes a pair of signal contacts 146 terminated to corresponding signals wires 104, 106. The cable assembly 140 also includes a ground shield 148 providing shielding for the signal contacts 146. In an exemplary embodiment, the ground shield 148 peripherally surrounds the signal contacts 146 along the entire length of the signal contacts 146 to ensure that the signal paths are electrically shielded from interference.

The support body 142 provides support for the contact sub-assembly 144 and ground shield 148. In an exemplary embodiment, the cables 102 extend into the support body 142 such that the support body 142 supports a portion of the cables 102. The support body 142 may provide strain relief for the cables 102. Optionally, the support body 142 may be manufactured from a plastic material. Alternatively, the support body 142 may be manufactured from a metal material. The support body 142 may be a metalized plastic material to provide additional shielding for the cables 102 and the cable assemblies 140. The support body 142 is sized and shaped to fit into the module cavity 132 and engage the support walls 130 to secure the contact modules 122 to the header housing 120.

Figure 3:
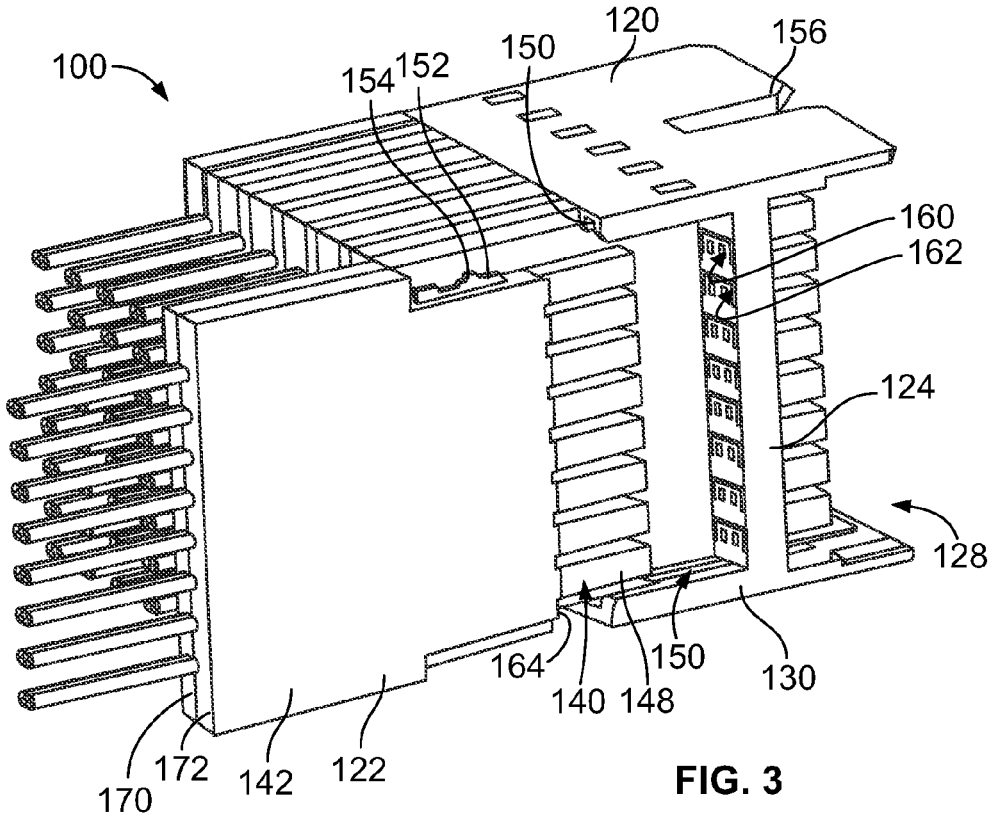
FIG. 3 is a rear perspective view of the cable header connector showing a contact module poised for loading into a header housing of the cable header connector.

FIG. 3 is a rear perspective view of the cable header connector 100 with one of the contact modules 122 outside of the header housing 120 and poised for loading into the header housing 120. The header housing 120 includes guide channels 150 in the support walls 130 to guide the contact module 122 into the header housing 120. The contact modules 122 include guide features 152 at the top and bottom of the support body 142 that are received in guide channels 150 for guiding the contact module 122 into the header housing 120.

In an exemplary embodiment, the contact module 122 includes a latch 154 that engages a corresponding latch element 156 (e.g. an opening) on the header housing 120 to secure the contact module 122 in the header housing 120. In the illustrated embodiment, the latch 154 on the contact module 122 is an extension extending outward from the guide feature 152, while the latch element 156 on the header housing 120 is an opening that receives the latch 154. Other types of latching features may be used in alternative embodiments to secure the contact module 122 to the header housing 120.

The header housing 120 includes a plurality of signal contact openings 160 through the base wall 124. The header housing 120 includes a plurality of ground shield openings 162 through the base wall 124. When the contact module 122 is coupled to the header housing 120, the signal contacts 146 (shown in FIGS. 1 and 2) are received in corresponding signal contact openings 160. The ground shield 148 is received in corresponding ground shield openings 162. The signal contact openings 160 and ground shield openings 162 may include lead-in features, such as chamfered surfaces, that guide the signal contacts 146 and ground shield 148 into the corresponding openings 160, 162, respectively. Portions of the signal contacts 146 and ground shield 148 extend forward from a front 164 of the support body 142. Such portions of the signal contacts 146 and ground shield 148 are loaded through the base wall 124 into the mating cavity 128 for mating with the receptacle connector (not shown). The front 164 of the support body 142 abuts against, or nearly abuts against, the base wall 124 when the contact module 122 is loaded into the header housing 120.

Multiple contact modules 122 are loaded into the header housing 120. The header housing 120 holds the contact modules 122 in parallel such that the cable assemblies 140 are aligned in a column. Any number of contact modules 122 may be held by the header housing 120 depending on the particular application. When the contact modules 122 are stacked in the header housing 120, the cable assemblies 140 may also be aligned in rows.

In the illustrated embodiment, the contact module 122 includes a first holder 170 and a second holder 172 coupled to the first holder 170. The first and second holders 170, 172 define the support body 142. The first and second holders 170, 172 hold the cable assemblies 140 therebetween. Optionally, the first and second holders 170, 172 may generally be mirrored halves that are coupled together and sandwich the cable assemblies 140 therebetween. Alternatively, the first and second holders 170, 172 may be differently sized and shaped, such as where one holder is a cover or plate that covers one side of the other holder.

Figure 4:
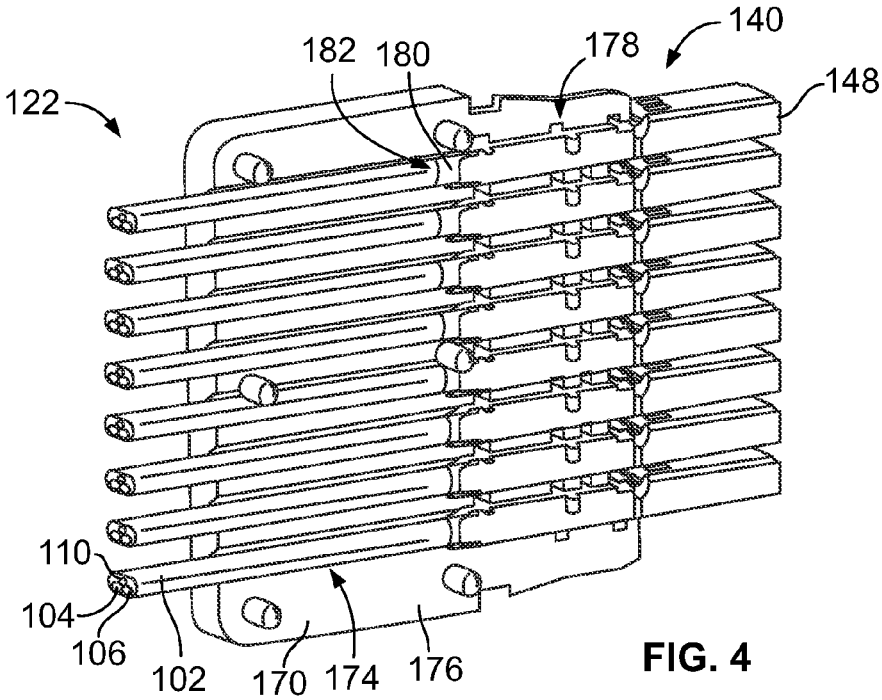
FIG. 4 is a perspective view of a portion of the contact module shown in FIG. 3.

FIG. 4 is a perspective view of a portion of the contact module 122 with the second holder 172 (shown in FIG. 3) removed to illustrate the cable assemblies 140 and cables 102. The first holder 170 includes a plurality of channels 174 at an interior 176 thereof. The channels 174 receive the cable assemblies 140 and the cables 102. Optionally, the second holder 172 may include similar channels that receive portions of the cable assemblies 140 and cables 102. During assembly, the cable assemblies 140 and cables 102 are loaded into the channels 174 of the first holder 170 and then the second holder 172 is coupled to the first holder 170, securing the cable assemblies 140 and cables 102 therebetween. In an exemplary embodiment, the first holder 170 includes pockets 178 that receive portions of the cable assemblies 140 to axially secure the cable assemblies 140 within the channels 174. The interaction between the cable assemblies 140 and the pockets 178 function as strain relief features for the cable assemblies 140 and cables 102.

In an exemplary embodiment, a ground ferrule 180 is coupled to an end 182 of the cable 102. The ground ferrule 180 is electrically connected to one or more grounded elements of the cable 102, such as the drain wire 110 (shown in FIG. 1) and/or the cable braids of the signal wires 104, 106 (shown in FIG. 1). The ground ferrule 180 is manufactured from a metal material and is electrically conductive. The ground shield 148 is electrically connected to the ground ferrule 180 to create a ground path between the cable assembly 140 and the cable 102.

Figure 5:
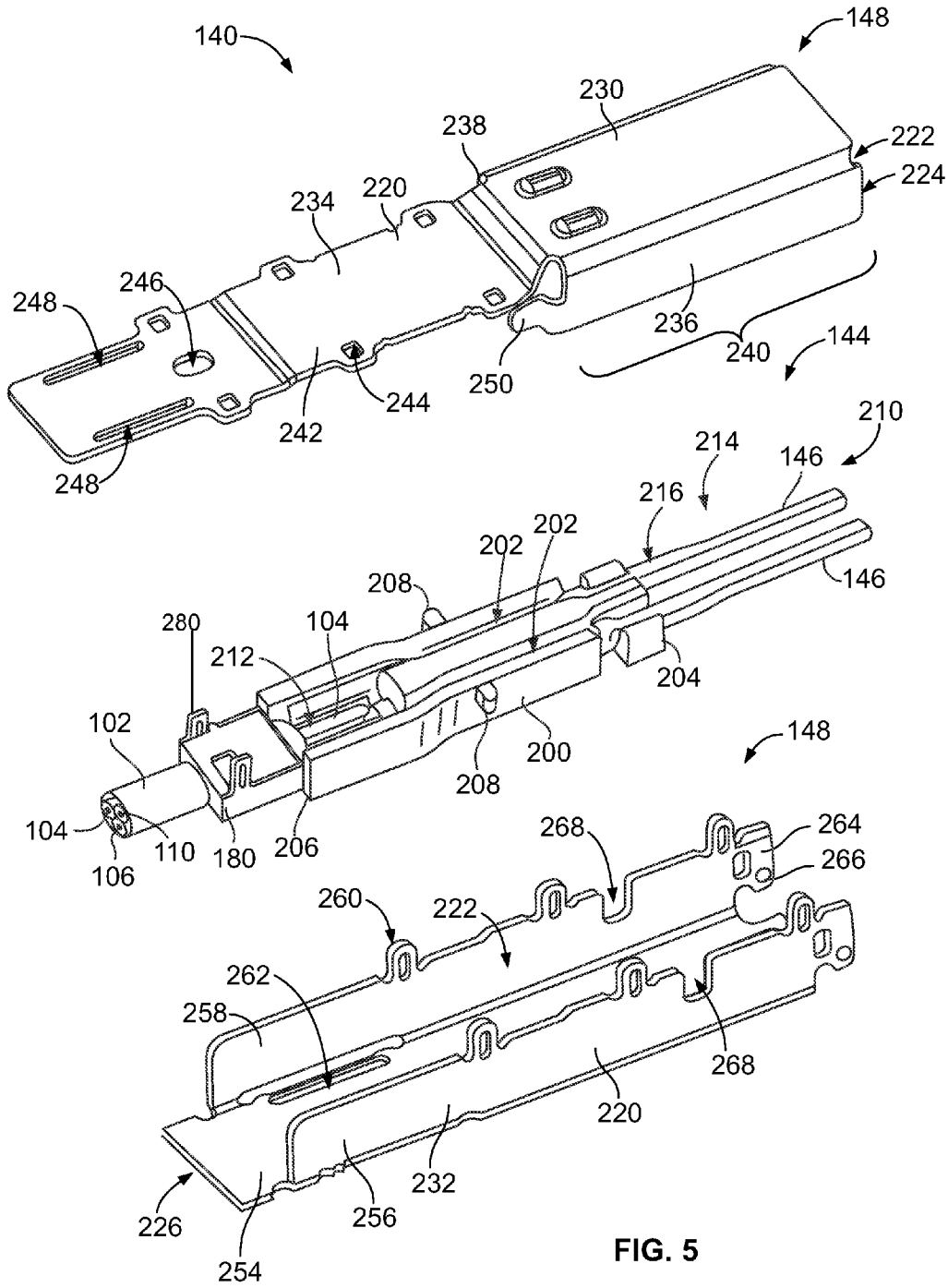
FIG. 5 is an exploded view of a cable assembly of the contact module.

FIG. 5 is an exploded view of one of the cable assemblies 140 illustrating the ground shield 148 poised for coupling to the contact sub-assembly 144. The contact sub-assembly 144 includes a mounting block 200 that holds the signal contacts 146. The mounting block 200 is positioned forward of the cable 102. The signal wires 104, 106 extend into the mounting block 200 for termination to the signal contacts 146. The mounting block 200 includes contact channels 202 that receive corresponding signal contacts 146 therein. The contact channels 202 are generally open at a top of the mounting block 200 to receive the signal contacts 146 therein, but may have other configurations in alternative embodiments. The mounting block 200 includes features to secure the signal contacts 146 in the contact channels 202. For example, the signal contacts 146 may be held by an interference fit in the contact channels 202.

The mounting block 200 extends between a front 204 and a rear 206. In an exemplary embodiment, the signal contacts 146 extend forward from the mounting block 200 beyond the front 204. The mounting block 200 includes locating posts 208 extending from opposite sides of the mounting block 200. The locating posts 208 are configured to position the mounting block 200 with respect to the ground shield 148 when the ground shield 148 is coupled to the mounting block 200.

The signal contacts 146 extend between mating ends 210 and terminating ends 212. The signal contacts 146 are terminated to corresponding signal wires 104, 106 of the cable 102 at the terminating ends 212. For example, the terminating ends 212 may be welded, such as by resistance welding or ultrasonic welding, to exposed portions of the conductors of the signal wires 104, 106. Alternatively, the terminating ends 212 may be terminated by other means or processes, such as by soldering the terminating ends 212 to the signal wires 104, 106, by using insulation displacement contacts, or by other means. The signal contacts 146 may be stamped and formed or may be manufactured by other processes.

In an exemplary embodiment, the signal contacts 146 have pins 214 at the mating ends 210. The pins 214 extend forward from the front 204 of the mounting block 200. The pins 214 are configured to be mated with corresponding receptacle contacts (not shown) of the receptacle connector (not shown). Optionally, the pins 214 may include a wide section 216 proximate to the mounting block 200. The wide section 216 is configured to be received in the signal contact openings 160 (shown in FIG. 3) of the header housing 120 (shown in FIG. 3) and held in the signal contact openings 160 by an interference fit. The narrower portions of the pins 214 forward of the wide section 216 may more easily be loaded through the signal contact openings 160 as the contact module 122 is loaded into the header housing 120 due to their decreased size, while the wide section 216 engages the header housing 120 to precisely locate the pins 214 forward of the header housing 120 for mating with the receptacle connector.

The ground shield 148 has a plurality of walls 220 that define a receptacle 222 that receives the contact sub-assembly 144. The ground shield 148 extends between a mating end 224 and a terminating end 226. The mating end 224 is configured to be mated with the receptacle connector. The terminating end 226 is configured to be electrically connected to the ground ferrule 180 and/or the cable 102. The mating end 224 of the ground shield 148 is positioned either at or beyond the mating ends 210 of the signal contacts 146 when the cable assembly 140 is assembled. The terminating end 226 of the ground shield 148 is positioned either at or beyond the terminating ends 212 of the signal contacts 146. The ground shield 148 provides shielding along the entire length of the signal contacts 146. In an exemplary embodiment, the ground shield 148 provides shielding beyond the signal contacts 146, such as rearward of the terminating ends 212 and/or forward of the mating ends 210. The ground shield 148, when coupled to the contact sub-assembly 144, peripherally surrounds the signal contacts 146. Because the ground shield 148 extends rearward beyond the terminating ends 212 of the signal contacts 146, the termination between the signal contacts 146 and the signal wires 104, 106 is peripherally surrounded by the ground shield 148. In an exemplary embodiment, the ground shield 148 extends along at least a portion of the cable 102 such that the ground shield 148 peripherally surrounds at least part of the cable braids of the signal wires 104, 106 and/or cable 102, ensuring that all sections of the signal wires 104, 106 are shielded.

The ground shield 148 includes an upper shield 230 and a lower shield 232. The receptacle 222 is defined between the upper and lower shields 230, 232. The contact sub-assembly 144 is positioned between the upper shield 230 and the lower shield 232.

In an exemplary embodiment, the upper shield 230 includes an upper wall 234 and side walls 236, 238 extending from the upper wall 234. The upper shield 230 includes a shroud 240 at the mating end 224 and a tail 242 extending rearward from the shroud 240 to the terminating end 226. The tail 242 is defined by the upper wall 234. The shroud 240 is defined by the upper wall 234 and the side walls 236, 238. In an exemplary embodiment, the shroud 240 is C-shaped and has an open side along the bottom thereof. The shroud 240 is configured to peripherally surround the pins 214 of the signal contacts 146 on three sides thereof. The upper shield 230 may have different walls, components and shapes in alternative embodiments.

The tail 242 includes press-fit features 244 that are used to secure the upper shield 230 to the lower shield 232. Other types of securing features may be used in alternative embodiments. In the illustrated embodiment, the press-fit features 244 are openings through the upper wall 234.

The tail 242 includes a drain wire opening 246 that receives at least a portion of the drain wire 110. The drain wire opening 246 may receive at least a portion of the ground ferrule 180 in addition to the drain wire 110.

The tail 242 includes ground ferrule slots 248 that receive portions of the ground ferrule 180. The ground ferrule slots 248 may be elongated. The ground shield 148 may engage the ground ferrule 180 at the ground ferrule slots 248 to electrically couple the ground ferrule 180 to the ground shield 148.

The shroud 240 includes tabs 250 extending rearward from the side walls 236, 238. The tabs 250 are configured to engage the lower shield 232 to electrically connect the upper shield 230 to the lower shield 232.

In an exemplary embodiment, the lower shield 232 includes a lower wall 254 and side walls 256, 258 extending upward from the lower wall 254. The lower shield 232 includes press-fit features 260 extending from the side walls 256, 258. The press-fit features 260 are configured to engage the press-fit features 244 of the upper shield 230 to secure the lower shield 232 to the upper shield 230. In the illustrated embodiment, the press-fit features 260 are compliant pins that are configured to be received in the openings defined by the press-fit features 244. Other types of securing features may be used in alternative embodiments to secure the lower shield 232 to the upper shield 230. The lower shield 232 may include a drain wire opening (not shown) similar to the drain wire opening 246 of the upper shield 230 that is configured to receive at least a portion of the drain wire 110 and/or the ground ferrule 180. In an exemplary embodiment, the lower shield 232 includes ground ferrule slots 262 in the lower wall 254. The ground ferrule slots 262 may receive portions of the ground ferrule 180.

The lower shield 232 includes tabs 264 extending forward from the side walls 256, 258. The tabs 264 are configured to engage the tabs 250 of the upper shield 230 to electrically connect the upper shield 230 to the lower shield 232. Optionally, the tabs 264 may include embossments 266 that extend from the tabs 264 to ensure engagement with the tabs 250. Optionally, the tops of the tabs 264 may be chamfered to guide mating of the tabs 264 with the tabs 250 during assembly of the ground shield 148.

The lower shield 232 includes openings 268 in the side walls 258. The openings 268 are configured to receive the locating posts 208 when the contact sub-assembly 144 is loaded into the ground shield 148. Other types of locating features may be used in alternative embodiments to position the contact sub-assembly 144 with respect to the ground shield 148 and/or to hold the axial position of the contact sub-assembly 144 with respect to the ground shield 148.

Figure 6:
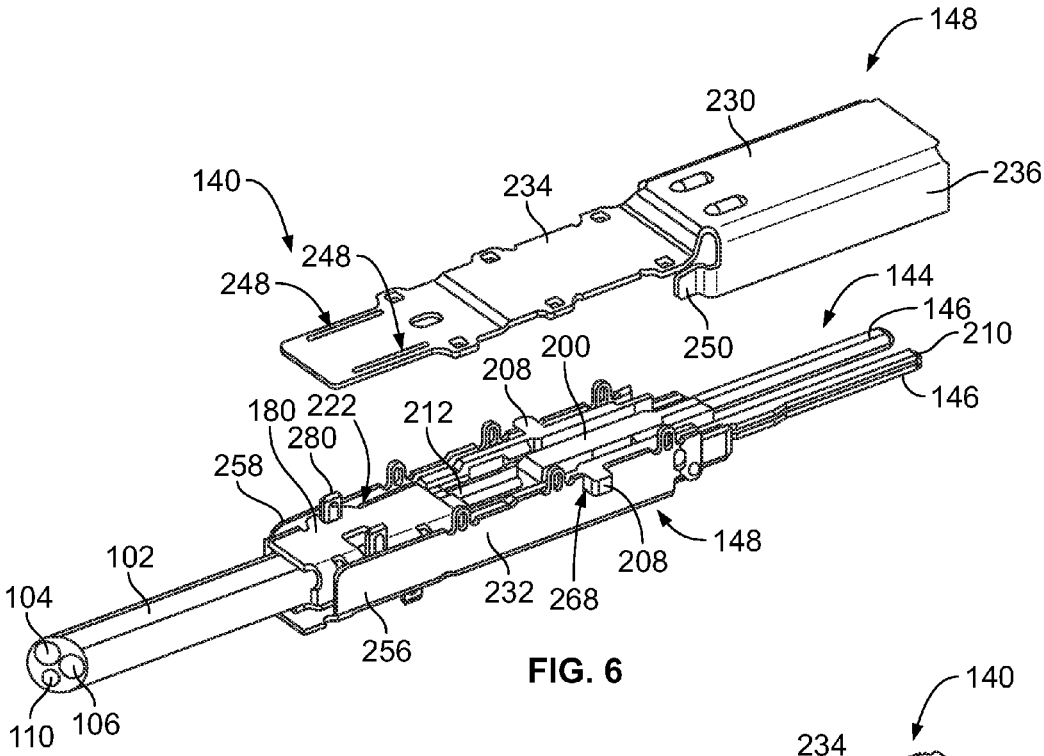
FIG. 6 is a partially assembled view of the cable assembly.
Figure 7:
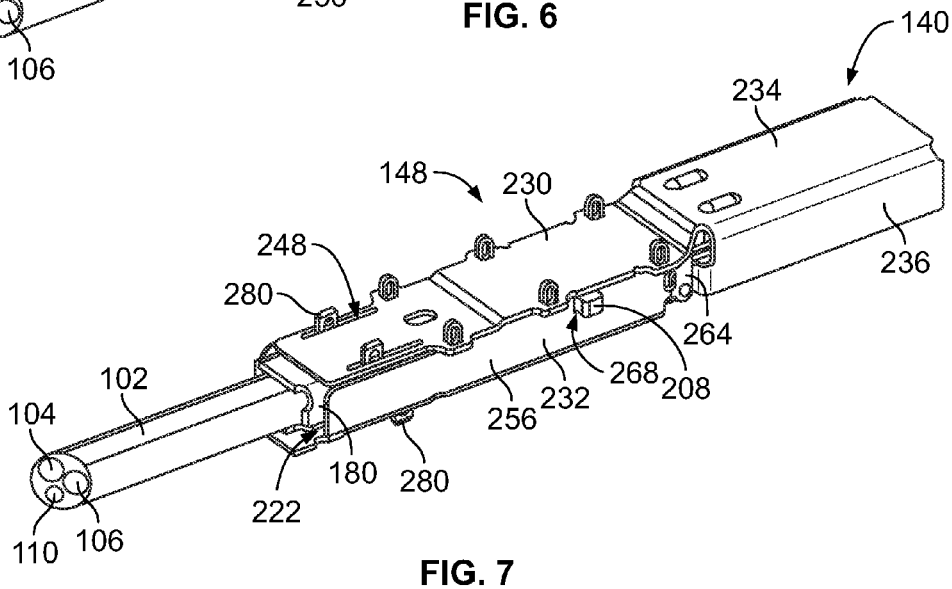
FIG. 7 is a top perspective view of the cable assembly.
Figure 8:
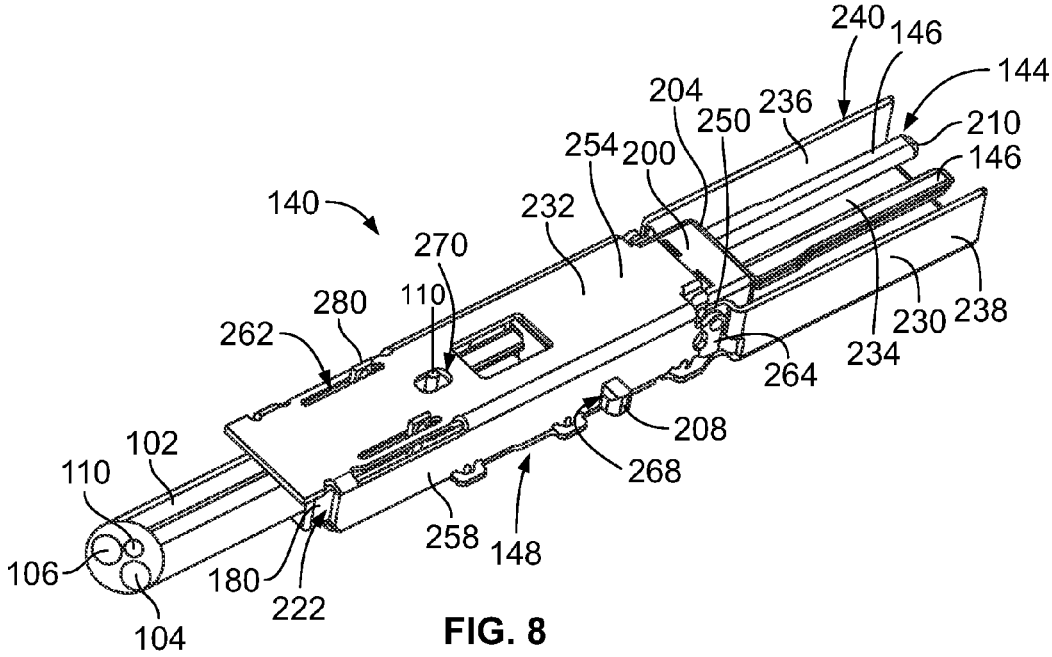
FIG. 8 is a bottom perspective view of the cable assembly.

FIG. 6 is a top perspective view of the cable assembly 140 showing the contact sub-assembly 144 loaded into the lower shield 232 with the upper shield 230 poised for mounting to the lower shield 232. FIG. 7 is a top perspective view of the cable assembly 140 showing the upper shield 230 coupled to the lower shield 232. FIG. 8 is a bottom perspective view of the cable assembly 140.

When the contact sub-assembly 144 is loaded into the receptacle 222, the mounting block 200 is positioned within the lower shield 232. The locating posts 208 are received in the openings 268 to secure the axial position of the contact sub-assembly 144 with respect to the ground shield 148. The ground ferrule 180 and a portion of the cable 102 are also received in the receptacle 222. The ground shield 148 provides peripheral shielding around the ground ferrule 180 and the cable 102. The ground ferrule 180 may be positioned immediately behind, and may engage, the mounting block 200 to provide strain relief for the cable 102 and/or the signal wires 104, 106. As shown in FIG. 8, the drain wire 110 extends through the drain wire opening 270 in the lower wall 254.

When the upper shield 230 and the lower shield 232 are coupled together, the tabs 280 of the ground ferrule 180 extend through the ground ferrule slots 262 of the lower shield 232 and extend through the ground ferrule slots 248 of the upper shield 230. The tabs 280 engage the lower shield 232 and the upper shield 230 to electrically connect the ground ferrule 180 to the ground shield 148. When the upper shield 230 and the lower shield 232 are coupled together, the tabs 250 of the upper shield 230 are held interior of the tabs 264 of the lower shield 232 and create an electrical path between the side walls 236, 238 of the upper shield 230 and the side walls 256, 258 of the lower shield 232.

The ground shield 148 provides electrical shielding for the signal contacts 146. The side walls 256, 258 of the lower shield 232 extend along sides of the signal contacts 146 and along side of the signal wires 104, 106, even within the cable 102. Similarly, the lower wall 254 of the lower shield 232 extends along a bottom of the signal contacts 146 and along a bottom of the signal wires 104, 106, including some length of the signal wires within the cable 102. When the upper shield 230 is coupled to the lower shield 232, the upper wall 234 extends along a top of the signal contacts 146 and the signal wires 104, 106, including some length of the signal wires within the cable 102. The side walls 236, 238 of the upper shield 230 extend along sides of the signal contacts 146. When the upper shield 230 is coupled to the lower shield 232, the side walls 236, 238 of the upper shield 230 engage and are electrically connected to the side walls 256, 258, respectively, of the lower shield 232. Continuous ground paths are created along the sides of the signal contacts 146 by the side walls 236, 238 and the side walls 256, 258. The sides of the signal contacts 146 are continuously covered along the entire length of the signal contacts 146. The upper wall 234 extends along the entire length of the signal contacts 146 to provide electrical shielding above the signal contacts 146 at or beyond the mating ends 210 of the signal contacts 146 to a location rearward of the terminating ends 212. The upper wall 234 may extend along at least part of the ground ferrule 180. The upper wall 234 may cover at least a portion of the cable 102. Similarly, the side walls 256, 258 and the lower wall 254 extend rearward beyond the terminating ends 212 and cover at least part of if not the entire ground ferrule 180 and at least part of the cable 102.

In the illustrated embodiment, the only portion of the signal contacts 146 that are not directly covered by the ground shield 148 is the bottom of the signal contacts 146 forward of the lower wall 254. However, with reference to FIG. 1, the ground shield 148 of the cable assembly 140 below the open bottom provides shielding along the bottom of the signal contacts 146. As such, within the cable header connector 100, each of the signal contacts 146 have electrical shielding on all four sides thereof for the entire lengths thereof by the ground shields 148 of the cable header connector 100. The electrical shielding extends at or beyond the mating ends 210 of the signal contacts 146 to at or beyond the terminating ends 212 of the signal contacts 146. As shown in FIG. 8, the mating ends 210 of the signal contacts 146 extend beyond the front 204 of the mounting block 200 such that the signal contacts 146 are exposed in the shroud 240. No portion of the mounting block 200 is between the mating ends 210, but rather, the mating ends 210 are separated by air and the mating ends 210 of the signal contacts 146 are separated from the shroud 240 of the ground shield 148 by air.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A cable header connector comprising:

a cable assembly comprising a contact sub-assembly configured to be terminated to a cable and a ground shield coupled to and providing electrical shielding for the contact sub-assembly;

the contact sub-assembly having a mounting block having contact channels therein, the contact sub-assembly having a single differential pair of signal contacts each received in corresponding contact channels, the signal contacts extending between mating ends and terminating ends, the signal contacts being terminated to corresponding signal wires of the cable at the terminating ends; and the ground shield having walls extending along the signal contacts the walls defining a receptacle, the ground shield having a mating end and a terminating end, the mating end of the ground shield being positioned either at or beyond the mating ends of the signal contacts, the terminating end of the ground shield being positioned either at or beyond the terminating ends of the signal contacts such that the ground shield provides shielding along the entire length of the signal contacts to provide electrical shielding for the single differential pair of signal contacts from signal contacts of another contact sub-assembly, wherein the receptacle is configured to receive only the single differential pair of signal contacts such that the ground shield electrically shields the single differential pair of signal contacts from any other differential pair of signal contacts.

2. The cable header connector of claim 1, wherein the ground shield entirely peripherally surrounds the termination of the signal contacts to the signal wires.

3. The cable header connector of claim 1, wherein the ground shield extends along a portion of the cable such that the ground shield peripherally surrounds at least part of a cable shield of the cable.

4. The cable header connector of claim 1, further comprising a ground ferrule configured to be mounted to an end of the cable, the ground shield extending along and peripherally surrounding a portion of the ground ferrule.

5. The cable header connector of claim 1, wherein the ground shield comprises an upper shield and a lower shield coupled to the upper shield, a receptacle being defined between the upper and lower shields, the contact sub-assembly being received in the receptacle and the receptacle being configured to receive only the single differential pair of signal contacts such that the lower shield and the upper shield electrically shield the single differential pair of signal contacts from any other differential pair of signal contacts.

6. The cable header connector of claim 1, wherein the ground shield includes a shroud at the mating end, the shroud being C-shaped and having an open side, the shroud peripherally surrounding the single differential pair of signal contacts to electrically shield the single differential pair of signal contacts from any other differential pair of signal contacts on three sides thereof.

7. The cable header connector of claim 1, wherein the ground shield comprises an upper shield and a lower shield, the lower shield having a receptacle that receives the contact sub-assembly therein, the upper shield having side walls, the lower shield having side walls, the side walls of the upper shield engaging the side walls of the lower shield to create continuous ground paths along the sides of the single differential pair of signal contacts.

8. The cable header connector of claim 1, wherein the ground shield comprises an upper shield and a lower shield, the upper shield comprising press-fit features, the lower shield comprising press-fit features engaging corresponding press-fit features of the upper shield to secure the lower shield to the upper shield by an interference fit.

9. The cable header connector of claim 1, wherein the ground shield includes an opening in at least one of the walls, the mounting block having at least one locating post extending therefrom, the at least one locating post received in the corresponding opening in the ground shield to position the contact sub-assembly with respect to the ground shield.

10. The cable header connector of claim 1, wherein the mating ends of the signal contacts extend beyond a front of the mounting block such that the signal contacts are separated by air and the signal contacts are separated from the ground shield by air.

11. A cable header connector comprising:

a contact module having a support body and a plurality of cable assemblies held by the support body, each cable assembly comprising a contact sub-assembly configured to be terminated to a cable and a ground shield coupled to and providing electrical shielding for the contact sub-assembly, the support body engaging and supporting the ground shields of the cable assemblies;

the contact sub-assembly having a mounting block having a contact channels therein, the contact sub-assembly having a pair of signal contacts each received in corresponding contact channels, the signal contacts extending between mating ends and terminating ends, the signal contacts being terminated to corresponding signal wires of the cable at the terminating ends; and the ground shield having walls extending along the signal contacts, the ground shield having a mating end and a terminating end, the mating end of the ground shield being positioned either at or beyond the mating ends of the signal contacts, the terminating end of the ground shield being positioned either at or beyond the terminating ends of the signal contacts such that the ground shield provides shielding along the entire length of the signal contacts.

12. The cable header connector of claim 11, wherein the contact module aligns each of the cable assemblies in a column.

13. The cable header connector of claim 11, wherein the contact module includes a first holder and a second holder coupled to the first holder, at least one of the first and second holders including channels that receive corresponding cable assemblies.

14. The cable header connector of claim 11, wherein the contact module is configured to engage and provide strain relief to the cables.

15. The cable header connector of claim 11, wherein the mating ends of the ground shields and the mating ends of the signal contacts extend forward of a front of the contact module.

16. The cable header connector of claim 11, further comprising a ground ferrule configured to be mounted to an end of the cable, wherein the ground shield extends rearward of the termination of the cable and the signal contacts such that the ground shield peripherally surrounds a portion of the ground ferrule, at least part of a cable shield of the cable, and the termination between the signal contacts and the signal wires.

17. A cable header connector comprising:

a header housing having a base wall;

contact modules coupled to the base wall, each contact module having a support body and a plurality of cable assemblies held by the support body, each cable assembly comprising a contact sub-assembly configured to be terminated to a cable and a ground shield coupled to and providing electrical shielding for the contact sub-assembly, the support body engaging and supporting the ground shields of the cable assemblies;

the contact sub-assembly having a mounting block having a contact channels therein, the contact sub-assembly having a pair of signal contacts each received in corresponding contact channels, the signal contacts extending between mating ends and terminating ends, the signal contacts being terminated to corresponding signal wires of the cable at the terminating ends; and the ground shield having walls extending along the signal contacts, the ground shield having a mating end and a terminating end, the mating end of the ground shield being positioned either at or beyond the mating ends of the signal contacts, the terminating end of the ground shield being positioned either at or beyond the terminating ends of the signal contacts such that the ground shield provides shielding along the entire length of the signal contacts.

18. The cable header connector of claim 17, wherein the base wall includes openings therethrough, the mating ends of the ground shields extending through corresponding openings, the mating ends of the signal contacts extending through corresponding openings.

19. The cable header connector of claim 17, wherein the contact modules are arranged in parallel and coupled to the header housing such that the cable assemblies are aligned in rows and columns.

20. The cable header connector of claim 17, further comprising a ground ferrule configured to be mounted to an end of the cable, wherein the ground shield extends rearward of the termination of the cable and the signal contacts such that the ground shield peripherally surrounds a portion of the ground ferrule, at least part of a cable shield of the cable, and the termination between the signal contacts and the signal wires.

* * * * *